United States Patent [19]

Foster

[11] 4,392,553

[45] Jul. 12, 1983

[54] TWO HAND SCANNING CHECK-OUT COUNTER

[75] Inventor: Stephen W. Foster, North Java, N.Y.

[73] Assignee: Almor Corporation, Ferndale, Mich.

[21] Appl. No.: 229,958

[22] Filed: Jan. 30, 1981

[51] Int. Cl.[3] ..... A47F 9/04

[52] U.S. Cl. ..... 186/61; 186/68

[58] Field of Search ..... 186/59–69

[56] References Cited

U.S. PATENT DOCUMENTS 3,083,791 4/1963 Shoffner ..... 186/65

4,182,433 1/1980 Foster ..... 186/68

*Primary Examiner*—F. J. Bartuska

*Attorney, Agent, or Firm*—Cullen, Sloman, Cantor, Grauet, Scott & Rutherford

[57] ABSTRACT

A supermarket-type check-out counter is formed of a forward customer unloading module and a rear bagging module. A pair of transversely spaced apart conveyors interconnect the two modules. The check-out operator stands in the space between the modules and between the conveyors to receive goods which are placed by a customer upon a movable belt carried upon the unloading module for movement of goods towards the operator. An indicia scanning device is mounted within the portion of the unloading module adjacent the operator and rearwardly of the belt. Thus, the operator, using both hands, removes goods from the belt, slides the goods over the scanning device, and then slides the goods rearwardly upon either of the two conveyors, on either side of the operator, so that the goods are conveyed to the upper surface of the bagging module for subsequent placing within bags.

1 Claim, 9 Drawing Figures

TWO HAND SCANNING CHECK-OUT COUNTER

BACKGROUND OF INVENTION

The invention herein relates to a supermarket-type check-out counter. An example of such counter is illustrated and described in my prior Pat. No. 4,182,433 issued Jan. 8, 1980.

In general, supermarket check-out counters are formed with a forward, customer unloading area and a rear, bagging area. Commonly, the customer unloading area is formed of a large cabinet upon which a belt-type conveyor is mounted. Thus, a retail customer in a supermarket, by way of example, unloads her shopping basket of goods upon the upper surface of the conveyor belt. Operation of the belt results in the merchandise moving longitudinally of the cabinet towards an operator station. The check-out operator receives the merchandise moved toward her and, at the point, records the costs of the merchandise on an appropriate cash register device.

Once the operator has recorded the charges, the goods are moved upon a rear cabinet area, which may be an extension of the forward cabinet or may be a separate cabinet, upon whose surface the goods remain momentarily. Then, either a separate, so called bagger, takes the goods and places them into bags for removal by the customer or, alternatively, the check-out operator places the merchandise into bags.

In prior check-out counters, one form of counter includes both a customer unloading belt, for carrying the merchandise to the operator, and a second belt upon which the operator places the checked goods for carrying to the bagging surface or deck of the rear of the counter. In some forms of counters, only one belt is used, i.e., the one carrying the merchandise to the check out operator. Thus, various arrangements of belts, or simply conveying surfaces upon which the goods are slid by either the customer or the check out counter have been utilized in the past.

In my prior patent, U.S. Pat. No. 4,182,433, identified above, the counter is formed of a pair of separate modules or cabinets, which are spaced apart. The two modules are interconnected by a conveyor belt which can be swung into a horizontal conveying position, or alternatively drop downwardly into a nonuse position.

Recently, scanning devices have become available which can read or sense the indicia imprinted upon goods and automatically record these within a computer-like cash register. For example, in a typical supermarket, each item of merchandise has some form of indicia imprinted thereon to designate the price. In one form, the price may be designated in readable numerals. In other forms, various lines or symbols of different thicknesses and lengths are utilized for that purpose. Whatever the form, there are now commercially available sensing devices or scanners which can read and record the information and thereby automatically ring-up the charges. Where such scanning devices are used, it is necessary for the check-out operator to properly position the goods over the sensing device. With the presently available types of counters, the positioning or movement of goods manually over the sensing device is relatively slow and requires some degree of careful movement and lifting of the goods by the operator.

The check-out counter of this application is constructed to have a built in sensing or scanning device with the counter being so arranged that the check-out operator can utilize both hands for rapid movement of goods, which are moved toward her, over the sensing device and to side conveyors located on either side of the operator, to carry the goods to the bagging counter. Thus, this counter contemplates a highly efficient check-out arrangement that permits very rapid movement of goods by the check-out operator over and through the sensing device and to the bagging area. This speeds up the customer checkout operation considerably.

SUMMARY OF INVENTION

The invention herein contemplates a check-out counter which essentially has a forward, customer merchandise unloading module having a conveyor belt for moving the goods towards an operator who stands at the rear edge of the module. A built in scanner at the rear portion of the module is arranged so that the operator may grasp goods, approaching toward her on the conveyor belt, with either hand and slide the goods over an area where the scanning device is located for automatically reading the indicia imprinted upon the goods. The counter further includes a pair of conveyor belts, located on either side of the operator so that the operator may manually slide the goods from the scanning device to either side of the conveyor with one rapid movement of either hand. Thereafter, the goods are conveyed to the bagging module located rearwardly of the operator, for the usual type of bagging by either a separate "bagger" or by the check-out operator who turns around to face the bagging module for bagging purposes.

In essence, the counter arrangement is made so that the operator may swing both arms forwardly and rearwardly for one hand movement of goods from the receiving conveyor, over the scanning device and to a removal conveyor located at the point along either side of the operator.

The invention contemplates a relatively inexpensive check-out counter construction which includes an extra conveyor belt so that the operator may work with two hands and thereby, materially speed up the check out operation. With this arrangement, the relatively expensive computer type cash register and scanning device can be utilized to the maximum for high speed check outs so as to reduce the number of counters which might be otherwise necessary in a relatively large retail store operation.

One of the purposes of the check-out counter of this application is to permit the use of inexperienced, relatively untrained, check-out personnel who operate at a rapid rate for manually moving goods, with the cash register pricing function being performed automatically and independently of the operator. Thus, the operator's function is essentially manual. This eliminates the presently available manually operated cash register systems or scanning systems which are relatively slow and require more movement and mental effort by the operator and consequently, are less efficient than the counter of this application.

These and other objects and advantages of this invention will become apparent upon reading the following description, of which the attached drawings form a part.

DETAILED DESCRIPTION

Figure 1:
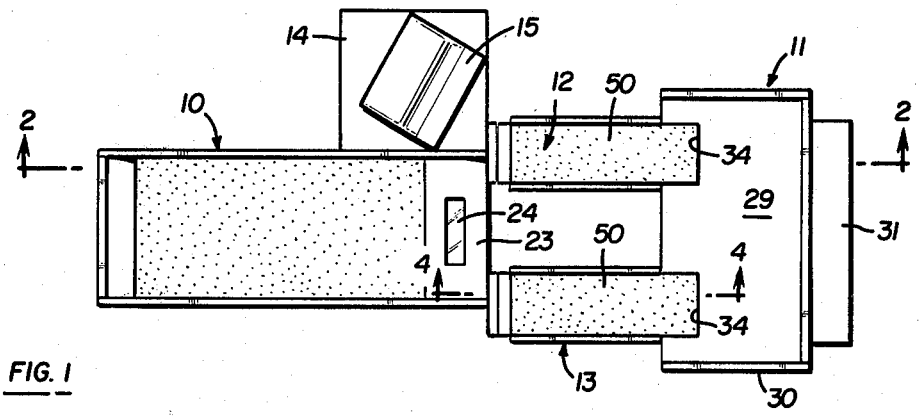
FIG. 1 is a plan view of the check-out counter.
Figure 2:
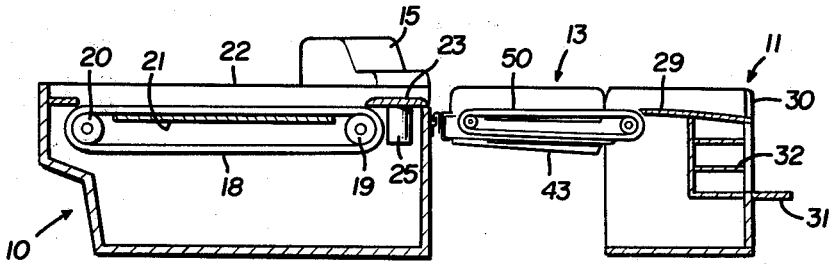
FIG. 2 is an elevational, cross sectional view taken in the direction of arrows 2—2 of FIG. 1.

The check-out counter is formed of a forward, customer unloading module or cabinet 10 and a rear, bagging module or cabinet 11. The two modules are spaced apart a considerable distance and are interconnected by a pair of transversely spaced apart side conveyors 12 and 13. A pedestal 14 is arranged along one side of the forward module. Upon the pedestal, a computer type cash register 15 is mounted.

The forward module includes an endless conveyor belt 18. The belt is supported by a forward roller 19 and a rear roller 20, between which a horizontal support plate 21 is arranged for supporting the upper reach of the belt. The rollers are appropriately driven by conventional drive motor mechanisms either for continuous operation or for intermittent, check-out counter operation, as is conventional. The drive mechanism for the conveyor belt is omitted since it is conventional and forms no part of this invention.

Raised side walls 22 bound the sides of the conveyor belt 18 to guide goods placed upon the conveyor surface by a customer. For example, in a typical supermarket operation, the customer gathers the goods in a shopping basket which is wheeled to the check-out counter. Then, the customer removes the goods and places them, one by one, upon the upper reach of the conveyor belt 18. Operation of the conveyor belt, either continuously or intermittently, by an on-off switch, moves the goods rearwardly toward the check-out counter operator.

A rear plate 23 is arranged at the rearward end of the forward module. The plate is provided with a window or opening 24 beneath which a conventional scanning device 25 is located. The scanning device, which is schematically illustrated, may be any one of the commercially available scanning devices which read or sense imprinted indicia. The particular scanning device used may vary, depending upon availability, cost, and the like and therefore, it is shown schematically here. The data sensed is transmitted to and recorded by the cash register 15.

The rear bagging module 11 is provided with a bagging deck or merchandise receiving surface 29. This surface is bounded by a raised wall 30. Goods received upon the receiving surface are normally placed, by a "bagger", i.e., an additional operator, within paper bags for removal from the store. Thus, a bagging support shelf 31 is provided at the rear end of the bagging module. Bag storage shelves 32 are formed within the bagging module adjacent the support shelf so as to provide a source of bags. In addition, bags may be stored within shelves located at the forward end of the bagging module or at the rear end of the customer unloading module so that the check-out operator may also bag when necessary and thus, have an available supply of bags handy.

Figure 9:
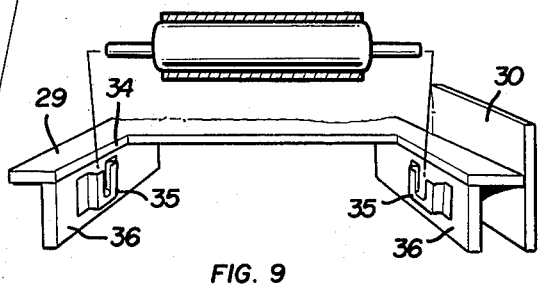
FIG. 9 is a perspective, fragmentary view, showing the means for mounting the side conveyors within the rear, bagging module.

A pair of notches 34 are formed in the bagging deck 29 of the rear module, as illustrated in FIG. 9. Roller support brackets 35 are positioned on opposite sides of each of the notches on support beams 36 which support the deck.

The side conveyors 12 and 13, each comprise a frame and an endless conveyor belt. In more detail, the frames each consist of a pair of plate-like side arms 40 secured together by an upper, horizontal plate 41, and a lower, horizontal plate 42. Side strips or walls 43 finish or cover the sides of the conveyors for decorative purposes. These may be formed of suitable metal or plastic strips which may be fastened by mechanical fasteners, such as screws, to the side arms 40.

Horizontal, rear notches 45 are formed at the rear ends of each of the side arms 40 to receive spindles 46 upon which a motor driven roller 47 is mounted. The motor 48 is arranged within the roller 47 and is designed to rotate the roller either continuously or intermittently, depending upon the kind of electrical controls and on-off switches used. The motor construction forms no part of this invention and therefore no further description is given here about here. However, rollers with internal drive motors of the type described above, are commercially available.

An endless conveyor belt 50 surrounds the motor driven motor 47 and extends to and around a forward idler roller 51 having spindles or axles 52 arranged within forward openings 53 in the side arms 40. The upper reach of each of the belts 50 is supported by the horizontal upper plate 41 which extends between its respective side arms 40.

Figure 8:
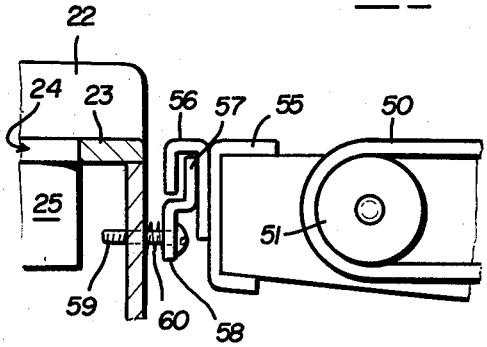
FIG. 8 is an enlarged, fragmentary view, showing one of the side conveyors locking means for fastening the conveyor in its upward, use position.
Figure 7:
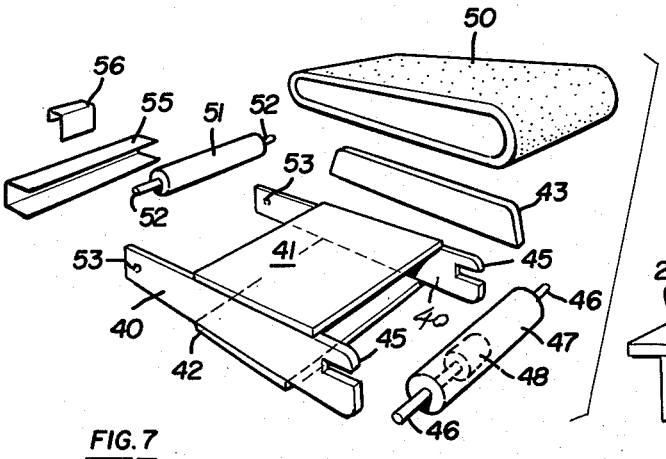
FIG. 7 is a perspective view showing the parts making up one of the side conveyors.

The forward end of each of the side conveyors has a trim channel 55 extending between the arms 40. Secured to each channel is a forward hook member 56 which engages the tongue 57 of a support strip 58 that is fastened by screws 59 to the rear surface of the customer unloading module. FIG. 8 illustrates the connection is an enlarged view. As can be seen, coil springs 60 surround the screws. The hook members 56 may be disengaged from the tongues 57 when the conveyor forward end is lifted upwardly. Then, the disengaged hook member 56 may slip downwardly past the tongue by pushing the tongue forwardly, towards the forward module, against the force of the coil springs. In that way, the side conveyors may each be lowered out of the way, when desired. Alternatively, they may be kept in their horizontal positions and supported by the support strips 58.

Figure 6:
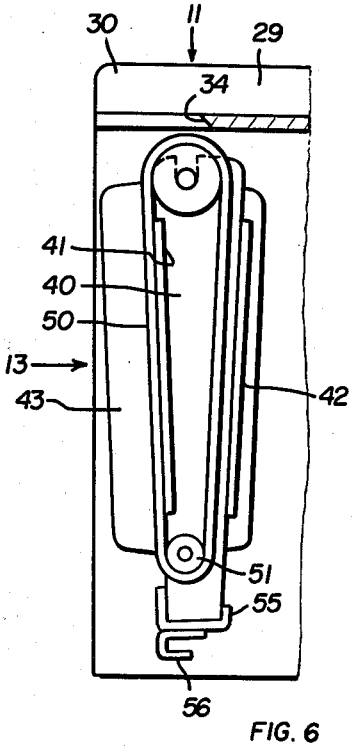
FIG. 6 is an enlarged, cross-sectional view, similar to FIG. 4, but showing the side conveyor dropped into its downward of non-use position.

Alternative forms of mechanical supports may be utilized for locking the side conveyors in horizontal use positions and for releasing them so they may be dropped downwardly into a vertical position as illustrated in FIG. 6.

Figure 3:
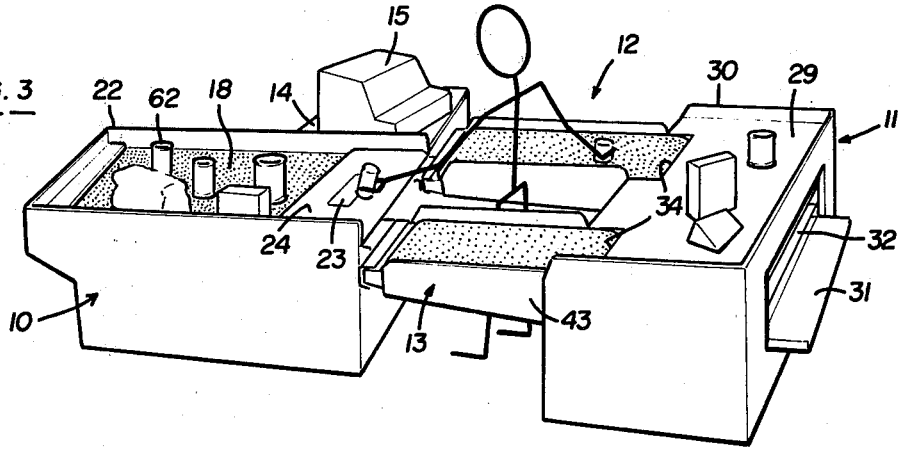
FIG. 3 is a perspective view of the counter.
Figure 4:
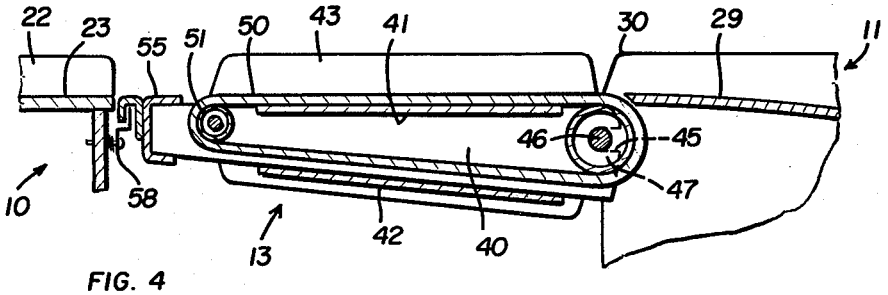
FIG. 4 is an enlarged, cross-sectional view of one of the side conveyors, taken in the direction of arrows 4—4 of FIG. 1.
Figure 5:
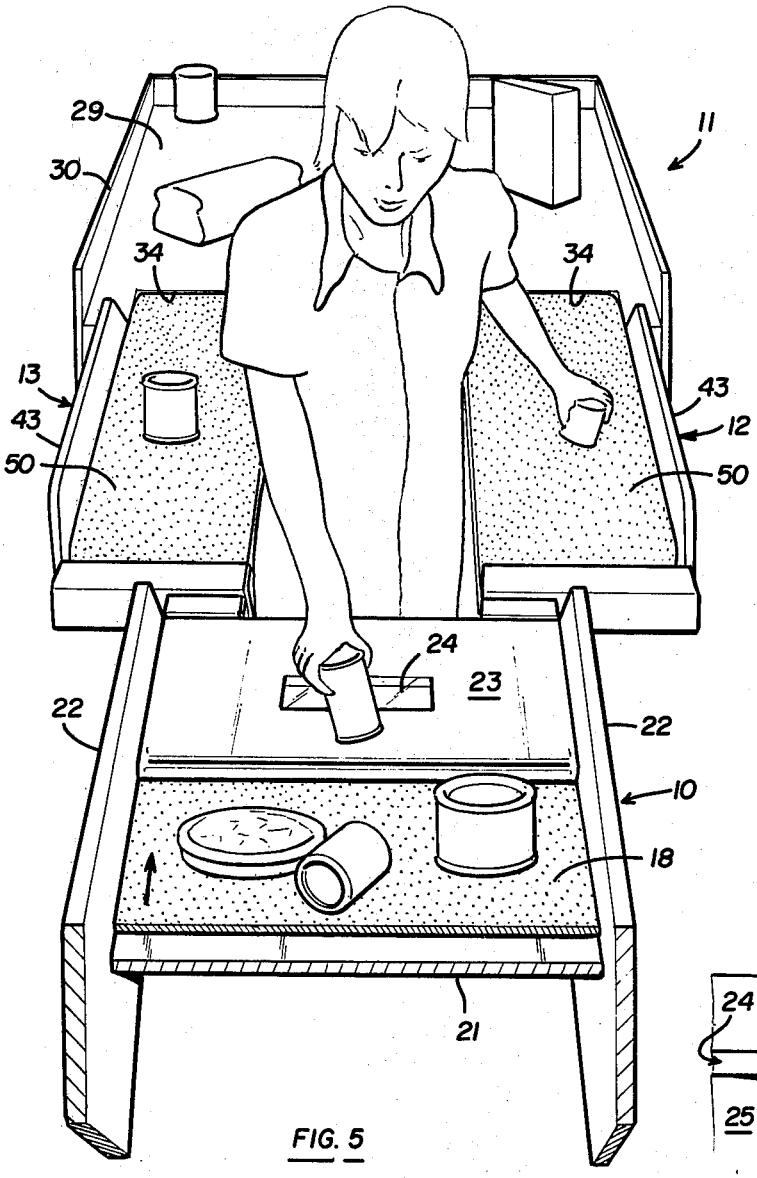
FIG. 5 is a perspective, fragmentary view looking from the forward toward the rear end of the check-out counter and showing an operator moving goods thereon.

As can be seen in the drawings, i.e., FIGS. 3 and 5, the checkout counter operator is located in the space between the forward and rear modules and between the side conveyors. The operator faces forwardly, i.e., towards the customer unloading module.

Goods, 62 are placed, by the customer, on the belt 18 of the forward module. The goods then move rearwardly to the operator who may grasp each item with either the left or the right hand. With one sweeping motion, the item is slid across the plate 23, over the window or opening 24, so that the scanner can read the indicia imprinted upon the goods. A continuation of the sweeping motion of the check-out counter operator's arm slides the goods rearwardly and sidwardly upon the adjacent side conveyor. Thus, there is a continuous forward and rearward motion of each of the arms of the operator to rapidly sweep the goods, first rearwardly over the scanning device and then continuously rearwardly and sidwardly over the side conveyor for automatic conveyance to the bagging deck.

The automatic scanning device, in cooperation with the computer type check-out register 15, records the prices and, in a conventional register, illuminates the price on a screen for the customer to observe. Meanwhile, the operator, being independent of the charge or cash recording function, is free to rapidly move her arms to sweep the goods rearwardly to the bagger. Consequently, the operation is swift, taking only a very small amount of time as compared to the conventional check-out counters.

To provide ingress or egress for the operator into the space, the operator may lower either one of the side conveyor belts. In addition, where a bagger is not available, i.e., during slow times, the operator may turn around, facing the bagging deck, and handle the bagging function likewise.

Having fully described an operative embodiment of this invention, I now claim:

1. A supermarket-type check-out counter comprising:

a relatively narrow, elongated, forward unloading module having an endless conveyor belt forming an upper, merchandise conveying surface for automatically moving goods from the forward end towards the rear end of the forward module;

a flat plate-like surface located rearwardly of the conveyor belt at the rear end of the forward module for forming a continuation of the module conveying surface;

an indicia scanning means located at the flat plate-like surface for sensing indicia imprinted upon goods which are slid over the flat surface, said scanning means arranged below said flat plate-like surface for scanning through a window-like area in said flat surface;

a relatively wide, rear bagging module, spaced a considerable distance rearwardly of the forward module, with the central longitudinal axes of the modules being in alignment, so that both opposite sides of the rear module extend transversely a greater distance than the corresponding sides of the forward module;

the upper surface of the rear module forming a merchandise receiving surface for use in placing goods located thereon into bags;

a pair of transversely spaced apart, elongated, side conveyor surfaces bridging the space between the forward and rear modules and with the opposite ends of said conveyor surfaces opening into their adjacent module ends, said side conveyors each being formed of an endless conveyor belt mounted upon a support frame means for providing continuously moving upper belt surfaces for automatically conveying goods to the bagging module merchandise receiving surface;

at least one of said side conveyor surfaces being hingedly connected to one module and releasably secured to the opposite module so that it may be manually movable out of normal position for providing ingress and egress for a check-out operator who is normally positioned in the space between the modules and side conveyor surfaces;

and the longitudinal axis of each of said side belts being transversely offset relative to the longitudinal axis of the unloading module belt, so that only a portion of the forward areas of each side belt transversely overlaps the adjacent side portion of the flat plate-like surface;

whereby goods unloaded by the customer upon the forward module conveyor belt are moved rearwardly to the operator who, using both hands, slides the goods across the flat surface for scanning the indicia, and then rearwardly and sidewardly upon either of the two side conveyor surfaces, along which surfaces the goods are moved to the rear module merchandise receiving surface for subsequent placement into bags.

* * * * *